US005524656A

United States Patent [19]

Konarski et al.

[11] Patent Number: 5,524,656

[45] Date of Patent: Jun. 11, 1996

[54] ARRANGEMENT FOR CLEANING DISPENSE VALVES

[75] Inventors: Jan Konarski, Hamburg; Klaus-Dieter Koppe; Michael Krapalis, both of Norderstedt, Germany

[73] Assignee: Fluid Management Limited Partnership, Wheeling, Ill.

[21] Appl. No.: 403,255

[22] Filed: Mar. 10, 1995

[51] Int. Cl.[6] ..... B08B 3/02

[52] U.S. Cl. ..... 134/198; 15/310; 15/345

[58] Field of Search ..... 134/155, 166 R, 134/169 R, 182, 186, 198; 15/310, 345, 346

[56] References Cited

U.S. PATENT DOCUMENTS 4,211,263 7/1980 Kennedy et al. .

5,353,823 10/1994 Peter ..... 134/182 X

FOREIGN PATENT DOCUMENTS

0516897A1 12/1992 European Pat. Off. .
3032182A1 4/1982 Germany ..... G01G 11/16
3818619A1 12/1989 Germany ..... G01G 13/295
2908453A1 9/1990 Germany .
4002255C2 2/1992 Germany .
849296 9/1960 United Kingdom .
1557469 12/1979 United Kingdom .

*Primary Examiner* Philip R. Coe
*Attorney, Agent, or Firm* Fitch, Even, Tabin & Flannery

[57] ABSTRACT

A cleaning nozzle directs a spray of cleaning solution against a dispense valve or other object to be cleaned. The cleaning nozzle is evacuated to draw away cleaning solution, establishing a flow of cleaning solution through the cleaning nozzle. The cleaning nozzle is mounted on an "X-Y table" to follow similarly mounted dispense valves in order to reduce down time for valve cleaning.

37 Claims, 10 Drawing Sheets

ARRANGEMENT FOR CLEANING DISPENSE VALVES

BACKGROUND OF THE INVENTION

1. Field of the Invention

The present invention pertains to the cleaning of multiple nozzle dispense heads, individual dispense valves and other equipment used to dispense a flowable medium.

2. Description of the Related Art

Dispensing equipment of the type contemplated herein typically includes a nozzle or dispense port from which a flowable medium emerges to enter into a receptacle. Viscous fluids, for example, tend to accumulate at the exterior surface of the nozzle after a dispense operation is completed. It may be desirable for reasons of cleanliness, sanitation or metering accuracy, to remove such residue, and accordingly several arrangements have been proposed to meet this need. For example, commonly owned German patent application P 43 31 924.6 proposes a generally cylindrical cleaning brush mounted for rotation on a horizontal axis within a vessel of cleaning fluid. The vessel is mounted for movement underneath a dispense nozzle. The brush is powered so as to rotate, cleaning the dispense nozzle by mechanical action of its bristles, and by bringing cleaning fluid to the surface of the dispense head as the brush rotates.

The medium being dispensed may vary widely in its characteristics. For example, a medium containing little or no pigment, such as a varnish, may be cleaned in a relatively easy manner. However, paints and other coatings which are heavily loaded with pigment materials may require considerably greater effort and corresponding increased quantities of cleaning fluids to successfully complete a cleaning operation. At times, dispense valves are employed to meter paint tints which are becoming increasingly concentrated over time, to provide a maximum amount of tinting ability in a minimum volume of tint material. Accordingly, it can be expected that a greater quantity of cleaning material would be required to remove such concentrated tinting materials. Perhaps an even greater challenge arises when dispense nozzles deliver highly viscous pasty materials in the form of offset printing inks. At times, such materials have been known to hang in substantial quantities from the underside of a dispense nozzle. The difficult flow characteristics of these materials is further aggravated by the amount of grit they contain. A brush, or other mechanical cleaning media, when brought in contact with such materials, quickly becomes fouled and action must be quickly taken to resolve the situation, before the materials harden.

SUMMARY OF THE INVENTION

It is an object of the present invention to provide an improved cleaning system for dispense nozzles and the like equipment, which deliver flowable materials to a receptacle.

Another object according to principles of the present invention is to provide a cleaning system of the above-described type in which contact with the residual material is kept to a minimum.

Another object according to principles of the present invention is to provide a cleaning system suitable for use with both static and moving dispense nozzles.

A further object according to principles of the present invention is to provide a cleaning system which can employ a number of different cleaning solutions in a single cleaning operation.

These and other objects according to principles of the present invention are provided in a cleaning nozzle which comprises:

a housing having opposed first and second ends, a sidewall extending between the first and second ends and an inlet wall at the second end;

a tapered wall extending from the first end;

a recess wall joined to the sidewall at a point remote from the first end of the housing;

the recess wall and the sidewall cooperating to form an open ended concave recess portion extending into the housing from the first end of the housing;

a standoff wall between the recess wall and the inlet wall, cooperating therewith to form an inlet chamber within the housing;

the tapered wall cooperating with the sidewall to form an outlet chamber;

the sidewall defining an outlet port communicating with the outlet chamber;

the inlet wall defining an inlet port communicating with the inlet chamber;

the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media;

the tapered wall defining at least one aperture communicating from the recess portion to the outlet chamber so that cleaning media can be withdrawn away from the recess portion to the outlet port.

Further objects according to principles of the present invention which will be become apparent from studying the appended description and drawings are provided in a cleaning mechanism which includes a cleaning nozzle of the above-described type, disposed on a platform which is mounted for movement in a plane located adjacent the dispense nozzle. The system comprises cleaning apparatus for cleaning a valve, including;

a nozzle housing having opposed first and second ends, a sidewall extending between the first and second ends and an inlet wall at the second end;

a tapered wall extending from the first end;

a recess wall joined to the sidewall at a point remote from the first end of the housing;

the recess wall and the sidewall cooperating to form an open ended concave recess portion extending into the housing from the first end of the housing;

a standoff wall between the recess wall and the inlet wall, cooperating therewith to form an inlet chamber within the housing;

the tapered wall cooperating with the sidewall to form an outlet chamber;

the sidewall defining an outlet port communicating with the outlet chamber;

the inlet wall defining an inlet port communicating with the inlet chamber;

the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media;

the tapered wall defining at least one aperture communicating from the recess portion to the outlet chamber so that cleaning media can be withdrawn away from the recess portion to the outlet port;

transport means for transporting the cleaning nozzle about a dispense area, comprising: a table supporting the cleaning nozzle, seating means for seating the cleaning nozzle against a part to be cleaned by moving the cleaning nozzle toward and away from the table, and the transport means further comprising x-y indexing means for moving the cleaning nozzle and table about a plane.

Figure 2:
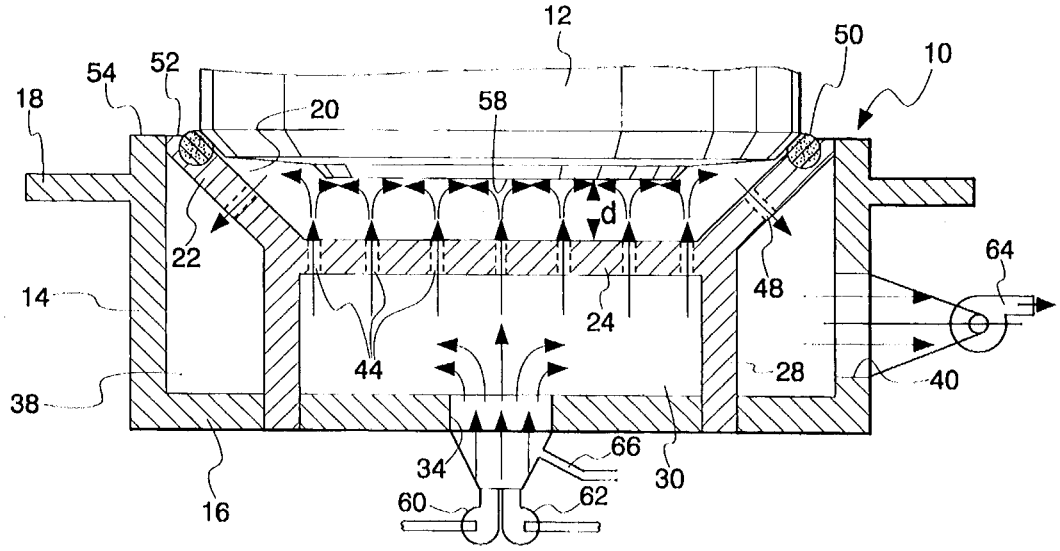
FIG. 2 is a cross-sectional view thereof taken along the line 2—2 of FIG. 1.
Figure 8:
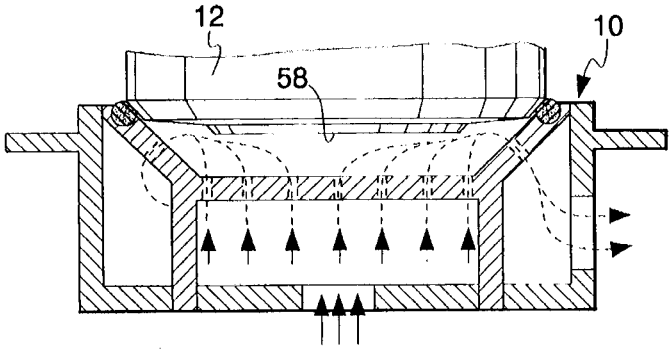
Figure 9:
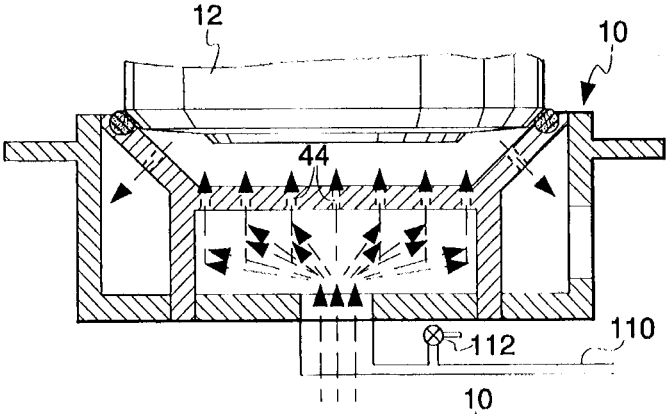
Figure 11:
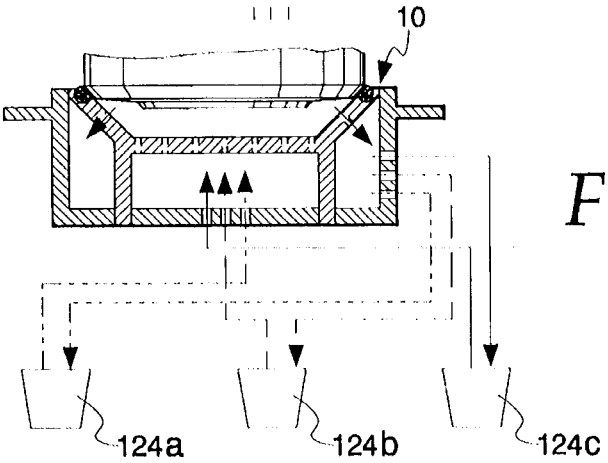
Figure 10:
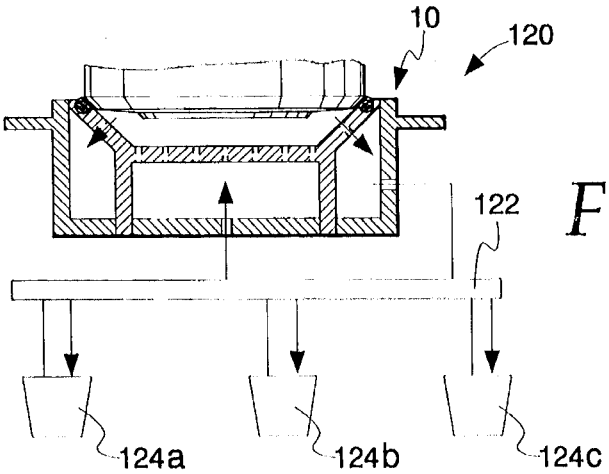
Figure 12:
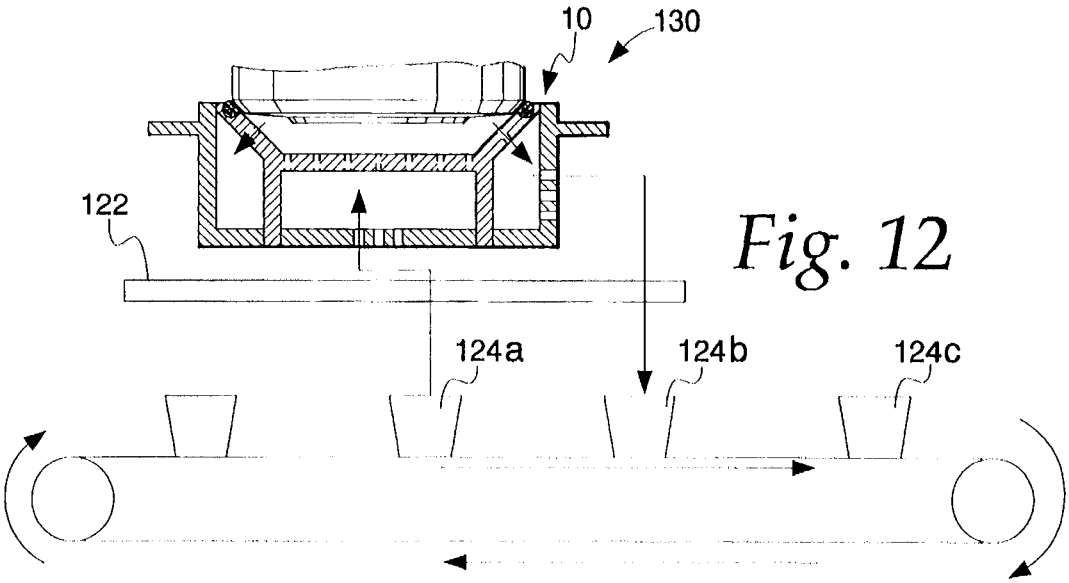
Figure 16:
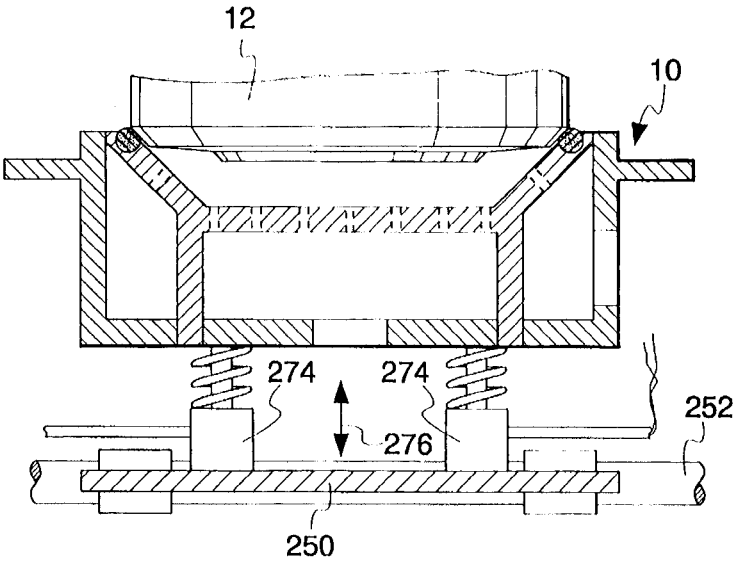
Figure 17:
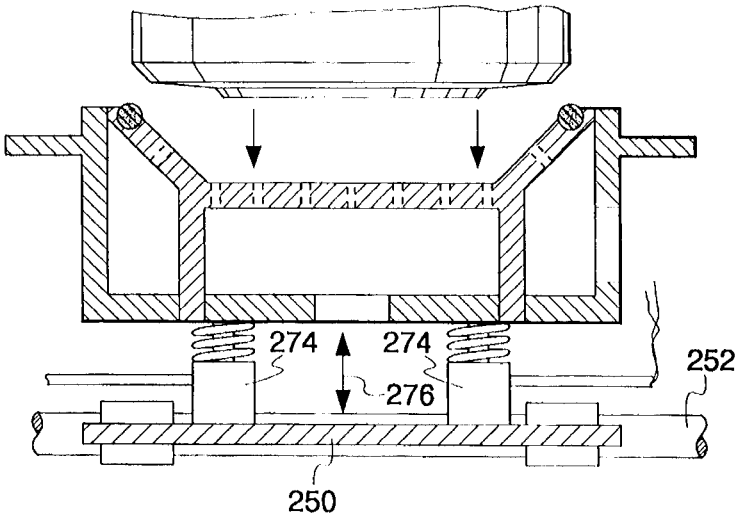
Figure 13:
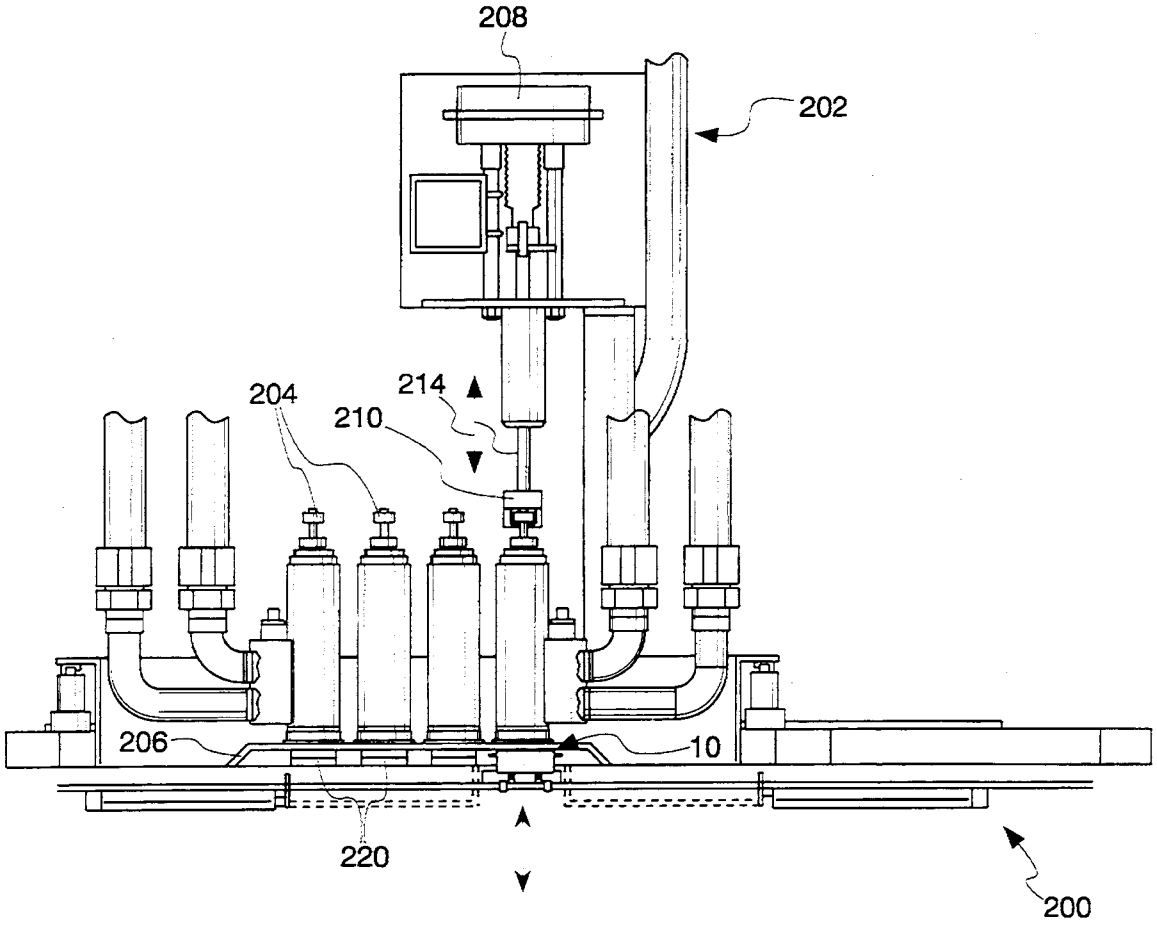
Figure 14:
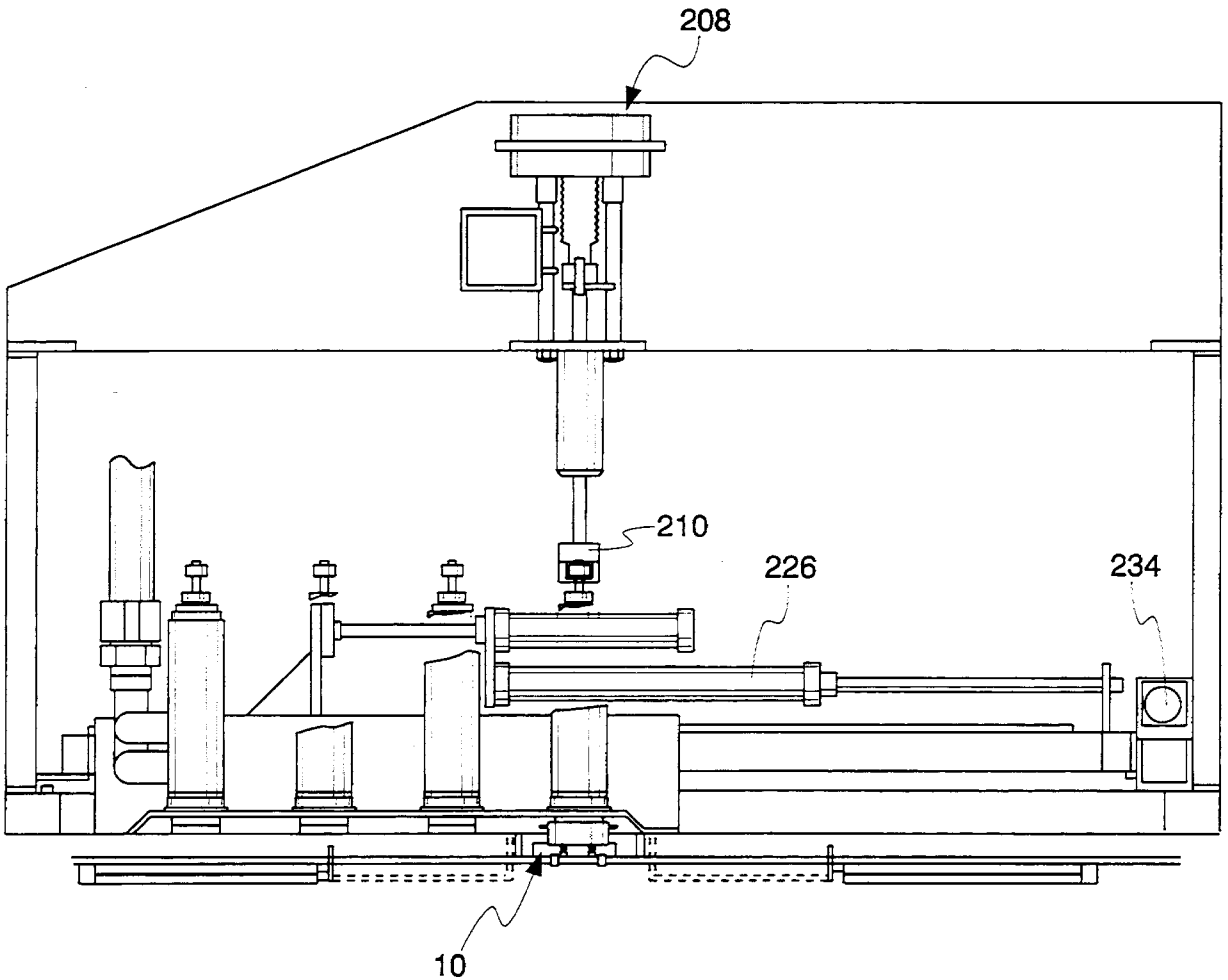
Figure 15:
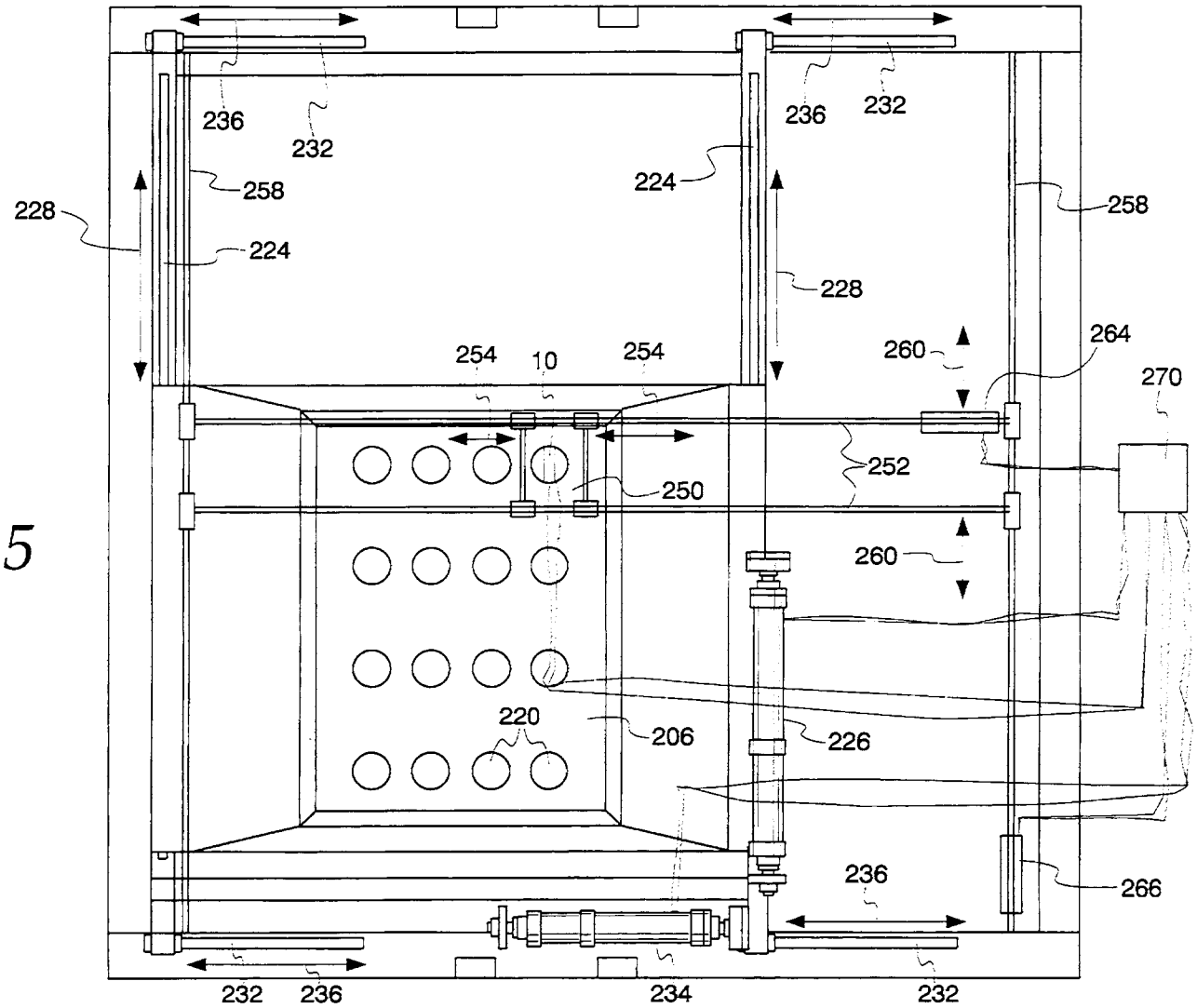
Figure 18:
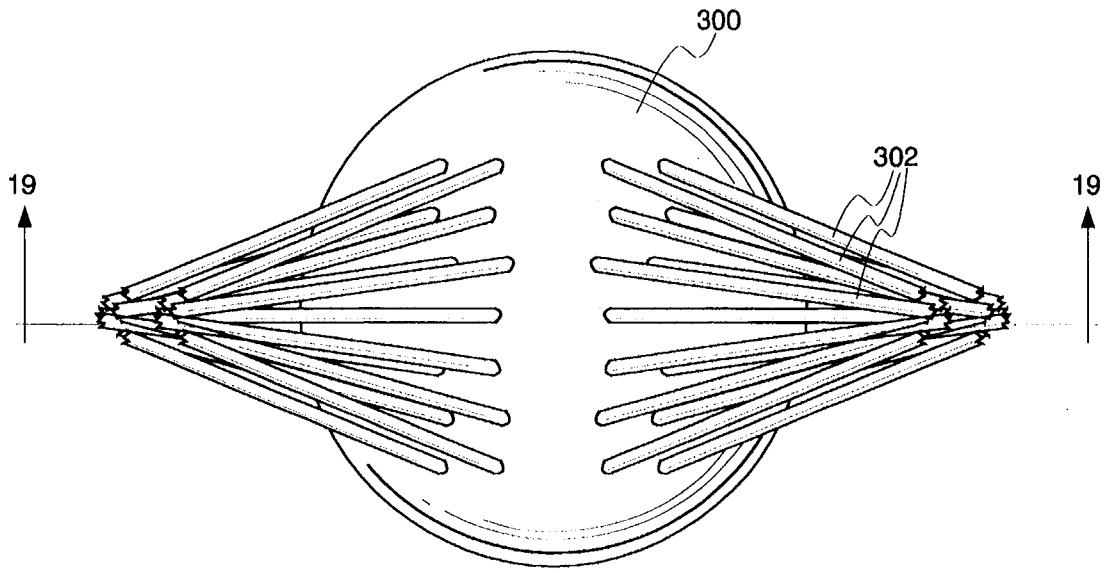
Figure 19:
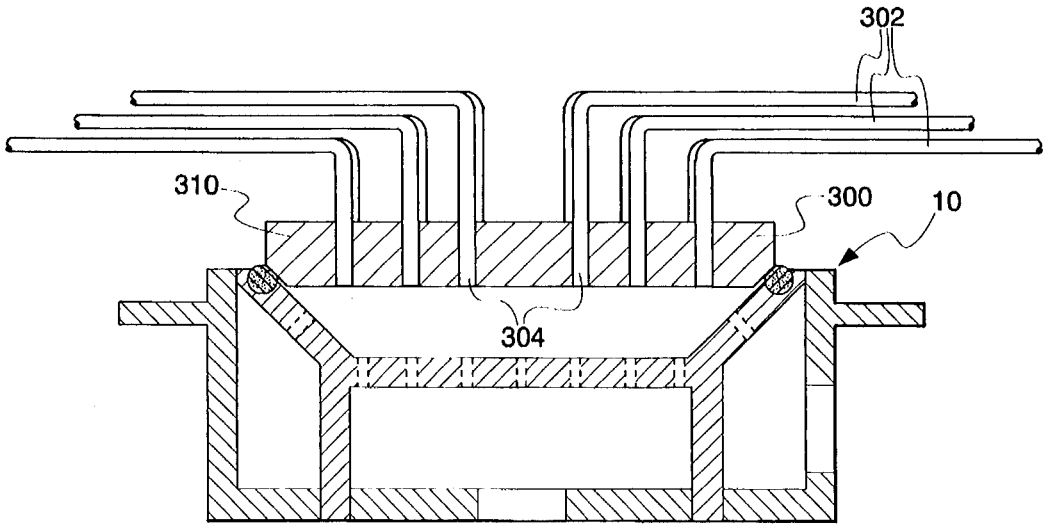

FIGS. *7a–7e* show a sequence of steps in operating the cleaning nozzle illustrated above in FIGS. 1 and 2;

FIG. 8 is a cross-sectional view of an alternative cleaning nozzle arrangement according to principles of the present invention;

FIG. 9 shows the nozzle of FIG. 8 in a subsequent stage of operation;

FIG. 10 shows a cleaning nozzle arrangement;

FIG. 11 is a cross-sectional view of an alternative cleaning nozzle arrangement according to principles of the present invention, schematically showing its operation;

FIG. 12 shows another embodiment of a cleaning nozzle arrangement according to principles of the present invention;

FIG. 13 is a side elevational view of a cleaning system according to principles of the present invention, mounted underneath an automated dispense system;

FIG. 14 is a front elevational view thereof;

FIG. 15 is a bottom plan view thereof;

FIG. 16 is a view similar to that of FIG. 2, but showing a portion of the valve mounting system on an enlarged scale;

FIG. 17 is a view similar to that of FIG. 16, showing a subsequent stage of operation;

FIG. 18 is a top plan view of a dispense head and cleaning nozzle arrangement;

FIG. 19 is a cross-sectional view thereof taken along the line 19—19 in FIG. 18.

DETAILED DESCRIPTION OF THE PREFERRED EMBODIMENTS

Figure 1:
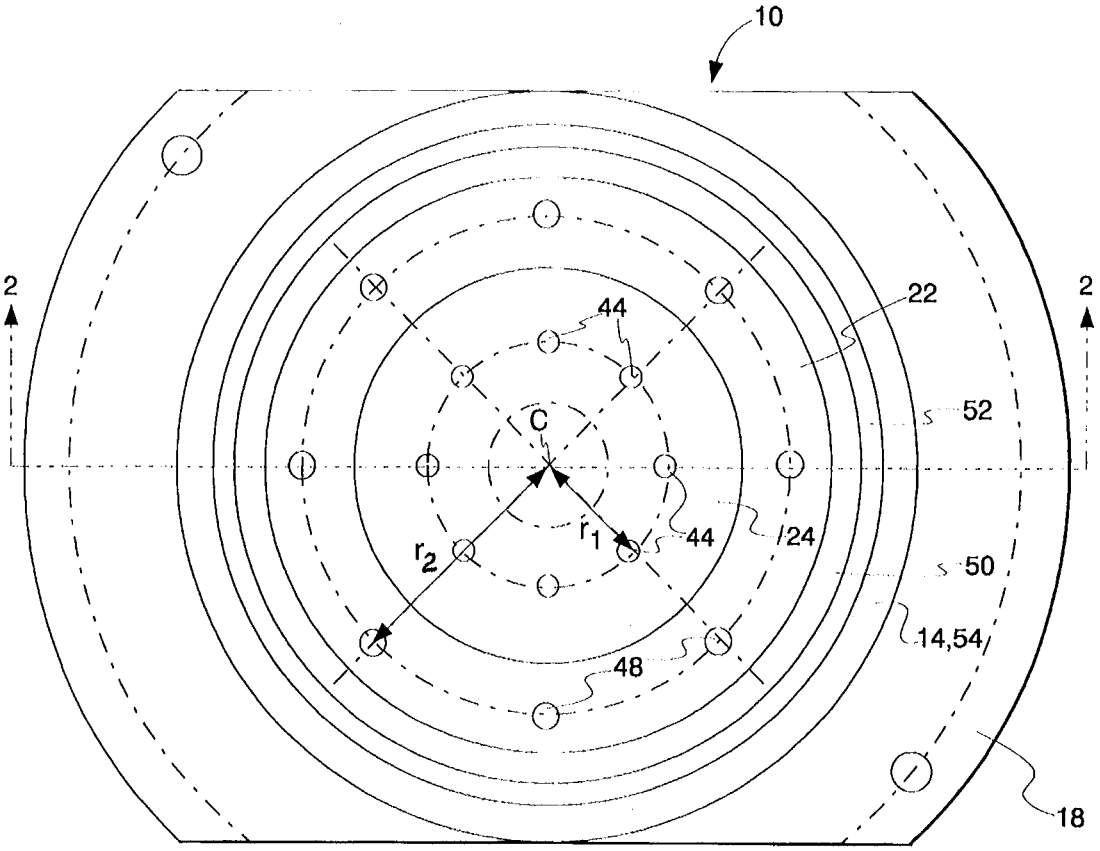
FIG. 1 is a top plan view of a dispense nozzle according to principles of the present invention.

Referring now to the drawings, and initially to FIGS. 1 and 2, a first embodiment of a cleaning nozzle according to principles of the present invention, is generally indicated at 10. In the cross-sectional view of FIG. 2, only the lower end of a dispense valve 12 is shown. The cleaning nozzle 10 includes an outer, generally cylindrical wall 14, which is preferably integrally formed with a bottom wall 16 and a mounting flange 18. A concave recess 20 is formed at the upper end of the dispense nozzle, by a generally frustoconical sidewall 22 joined at its lower end to a recess wall 24. Members forming recess 20 are spaced above bottom wall 16 by a generally cylindrical standoff 28, cooperating with the bottom wall to form a substantially enclosed entry chamber 30. The bottom wall 16 defines an opening 34 through which one or more types of cleaning media enter chamber 30.

The standoff 28 and sidewall 22 cooperate with wall 14 and bottom wall 16 to form a generally annular evacuation chamber 38. An exit aperture 40 is formed in wall 14 for communication with a vacuum source, shown schematically in FIG. 2 as fan 64. A series of holes 44 are formed in recess 24. Cleaning media in chamber 30 passes through holes 44 to recess 20, exiting through holes 48 formed in sidewall 22, so as to enter evacuation chamber 38.

Cleaning nozzle 10 preferably comprises an elastomeric gasket 50 formed at the upper end 52 of sidewall 22, being located adjacent the upper end 54 of wall 14. As indicated in FIG. 2, the elastomeric gasket 50 is dimensioned to sealingly engage nozzle 12, so as to effectively enclose recess 20, forming a cleaning chamber therewith.

In operation, cleaning media enters opening 34 at the bottom of the cleaning nozzle, entering chambers 30. The cleaning media then passes through holes 44 to enter recess 20. In the preferred embodiment, holes 44 have a length substantially greater than their cross-sectional size so as to collimate or give direction to the cleaning media passing therethrough. Cleaning media passing the upper surface of recess wall 24 emerges from holes 44, being directed onto the exposed surface 58 of valve 12 with sufficient momentum to clean the valve surface. The cleaning media is then drawn through holes 48 in wall 22 to enter evacuation chamber 38, being drawn out through hole 40 in wall 14.

In the preferred embodiment, the holes 44, 48 are arranged along two concentric circles, and most preferably, are aligned in pairs along radial lines. As illustrated in FIGS. 1 and 2, it is generally preferred that the holes 44 be located along a circle spaced from the center of the valve surface to be cleaned, even though it is important that the center of the valve surface be cleaned as effectively as the rest of the surface.

Further, it is important that the pattern of media flow within recess 20 does not form pockets of stagnation, with flow streams of media entering and exiting the chamber conflicting with one another in a way which disturbs a continuous flow through the cleaning nozzle. Accordingly, in one of the preferred embodiments illustrated in the figures, it will be seen that the sidewall 22 is formed generally at a 45 degree angle and that gasket 50 is positioned such that the surface 58 of the cleaning nozzle is disposed a distance d from the top surface of recess wall 24. In the preferred embodiment, the distance d is generally one-half the radial distance r1, a radial distance of holes 44 from the center c of the cleaning nozzle, which corresponds to the center of the dispense valve being cleaned. Further, the holes 48 are approximately twice as far away from center c as are the holes 44, and accordingly $r_2$ is generally twice the distance of $r_1$. In the most preferred embodiment, the distance d is slightly less than one-half the distance $r_1$ and is approximately 45% of the distance of $r_1$. Further, it will be noted from FIG. 1 that the holes 48 are larger in size than the holes 44. It has been found that the relative size and location of holes 44, 48 is important to ensure a continuous flow of cleaning media through the cleaning nozzle 10. With reference to FIG. 2, it will be seen that holes 48 are spaced above the upper surface of recess wall 24 so as to reduce the need for flow exiting holes 44 to reverse in direction, before exiting to holes 48. In a preferred embodiment, the bottoms of holes 48 are positioned at generally one-half the distance d above the upper surface of recess wall 24.

It will be appreciated that valves of different configuration may require a different relative spacing of components of cleaning nozzle 10, differing from that shown and described above. However, it is generally preferred that the holes 48 be located outside of the holes 44 and that the holes 48 be located above the recess wall 24 in which holes 44 are formed.

Figure 3:
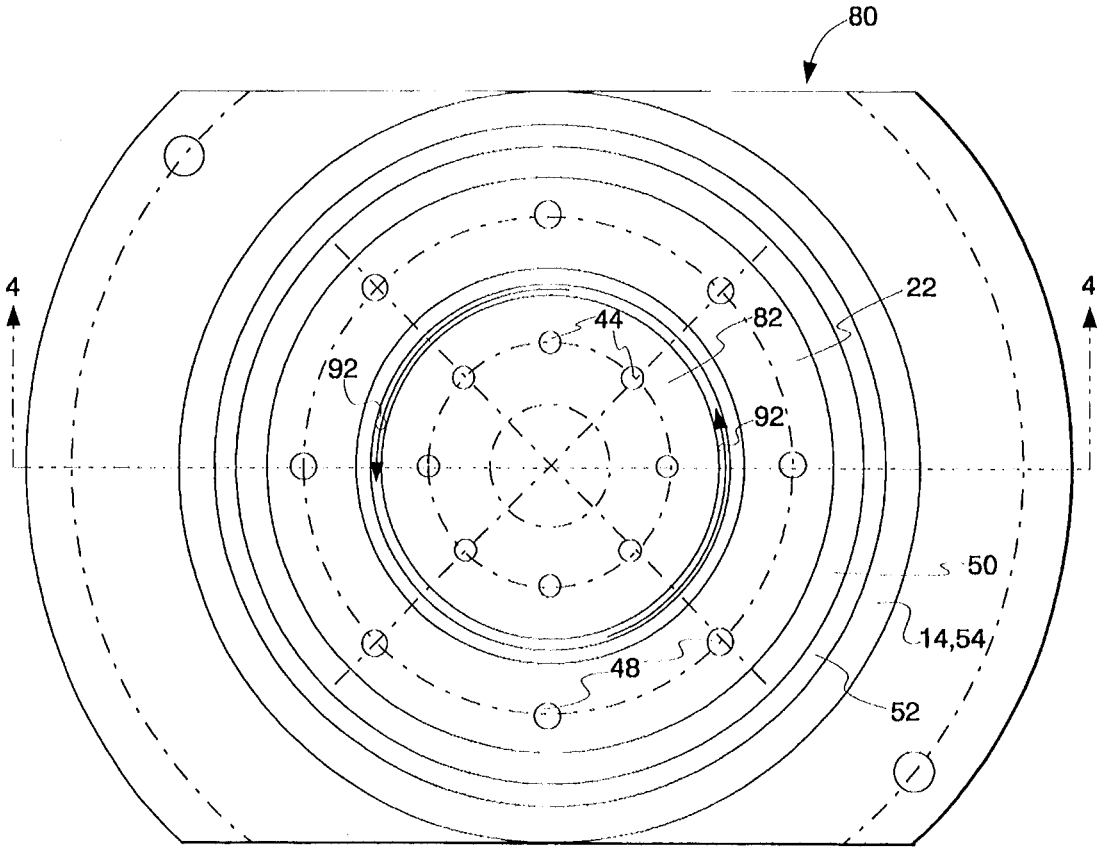
FIG. 3 is a top plan view of an alternative embodiment of the cleaning nozzle according to principles of the present invention.
Figure 4:
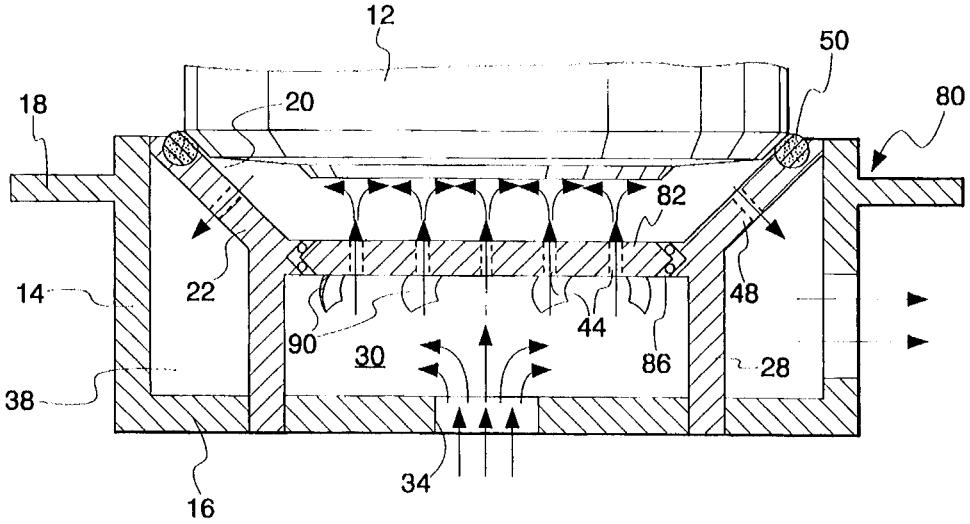
FIG. 4 is a cross-sectional view taken along the line 4—4 thereof.

As will be seen herein, nozzle 10 can accommodate different types of cleaning media flows, without requiring modification. For example, the cleaning media entering hole 34 may come from a variety of sources. For example, cleaning media may pass through a pump 60 which provides a steady pressurized flow of cleaning media entering chamber 30. Alternatively, cleaning media may pass through a pump 62 which pulsates the pressurized flow of cleaning media, sending pulses or spaced waves of cleaning media into chamber 30. FIG. 8 illustrates, in schematic form, the pulsating operation of nozzle 10, described above, with waves of cleaning media impacting surface 58 of dispense valve 12. Accordingly, the cleaning flow impinging on valve surface 58 may either be a steady flow, or may be pulsating. In an alternative arrangement, cleaning media may be drawn from inlet conduit 66 by suction forces created by vacuum pump 64. In either event, cleaning spray is ejected from evacuation chamber 38 by a vacuum pump 64. As seen above, the cleaning nozzle 10 is formed from a minimum number of inexpensive components, and can be quickly and easily serviced, if necessary, especially since it contains no moving parts. Turning now to the arrangement of FIGS. 3 and 4, an alternative embodiment of a cleaning nozzle is generally indicated at 80. Cleaning nozzle 80 is essentially identical in construction to cleaning nozzle 10, except for the recess wall, indicated by the referenced numeral 82 in the figures. As can be seen in FIG. 4, the recess wall 82 is separated from the standoff 28 and the sidewall 22, being freed for rotation about the center axis of the cleaning nozzle 80. Recess wall 82 is mounted by bearings 86 to the upper end of entry chamber 30, at a point adjacent to joinder of standoff 28 and sidewall 22, thereby reducing frictional losses which might otherwise impair the free rotation of the recess wall. A plurality of turning vanes 90, generally resembling turbine blades, are located on the underneath surface of recess wall 82. A portion of the flow entering holes 44 from entry chamber 30 impinges on turning vanes 90, thereby rotationally driving recess wall 82 in the direction shown by arrows 92 in FIG. 3. Thus, a rotational velocity is imparted to flow exiting holes 44, creating a swirl pattern within recess 20.

Figure 5:
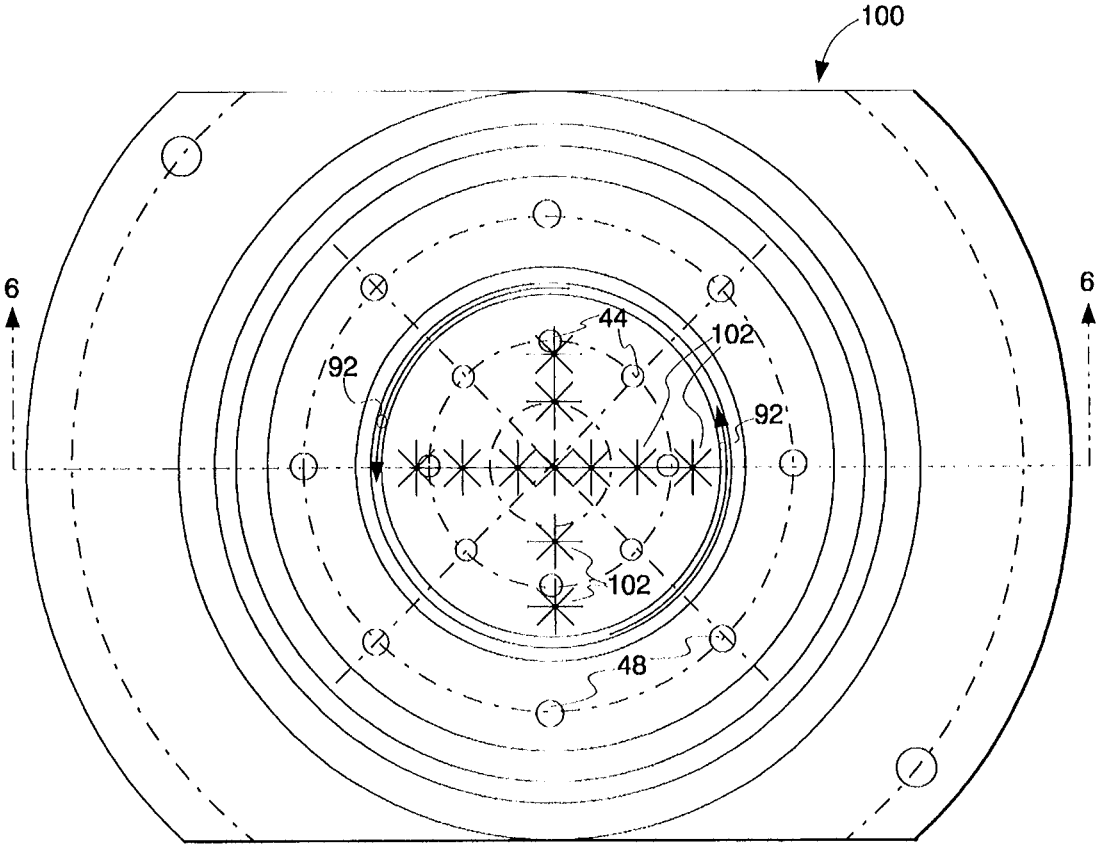
FIG. 5 is a top plan view of yet another alternative embodiment of a cleaning nozzle according to principles of the present invention.
Figure 6:
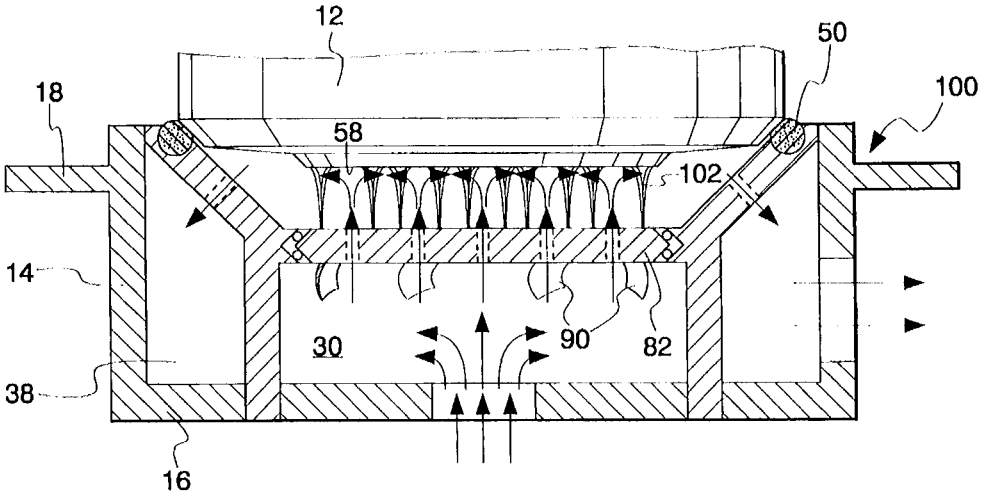
FIG. 6 is a cross-sectional view taken along the lines 6—6 of FIG. 5.

Turning now to FIGS. 5 and 6, cleaning nozzle 100 is substantially identical to cleaning nozzle 80 described above, except for the addition of upstanding bristles 102 attached to the upper surface of recess wall 82. The bristles may take other forms, conventionally available, other than that shown in the figures, and a smaller or larger number of bristles may be employed. Further, the bristles could be replaced by a sponge pad riding atop the surface of recess wall 82, substantially filling the space between recess wall 82 and the surface 58 of the dispense valve 12. The sponge will become loaded with cleaning media and thereby provide cleaning media contacting surface 58 of dispense valve 12. Alternatively, the sponge could be perforated to allow spray to impact the surface 58. Further, bristles 102 could be replaced by other mechanical cleaning media, such as an abrasive screen, or a fiber pad, conventionally available for such purpose.

Figure 7A:
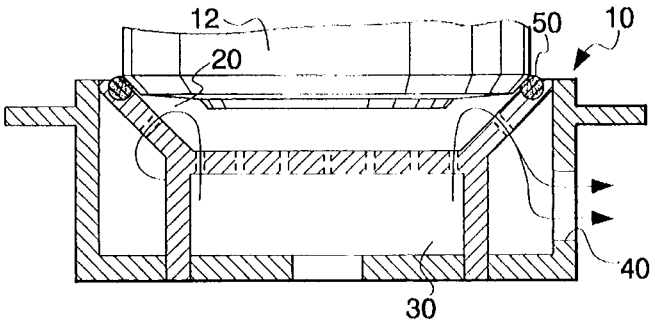

Turning now to FIGS. 7*a*-7*e*, a cleaning cycle according to principles of the present invention will be described. As shown in FIG. 7*a*, a vacuum is initially drawn in cleaning nozzle 10 under the force of vacuum pump 64 which is shown in FIG. 2. The gasket 50 preferably forms an hermetic seal with respect to dispense valve 12, so as to create an hermetically sealed chamber surrounding the recess 20. As will be seen herein, it is generally preferred that cleaning nozzle 10 be mechanically raised in position against valve 12. This alone may be relied upon to provide the necessary hermetic seal between gasket 50 and valve 12. However, the negative pressure applied to the interior of the cleaning nozzle could also be relied upon for this purpose.

Figure 7B:
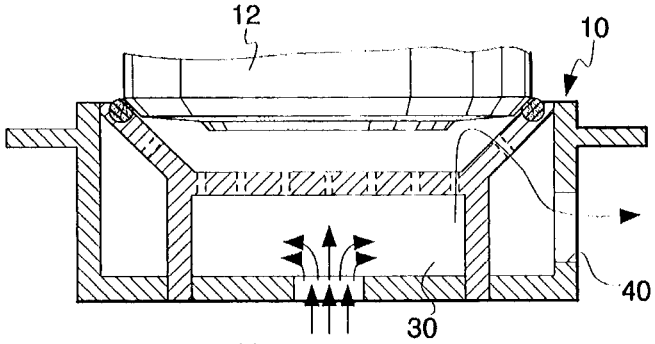
Figure 7C:
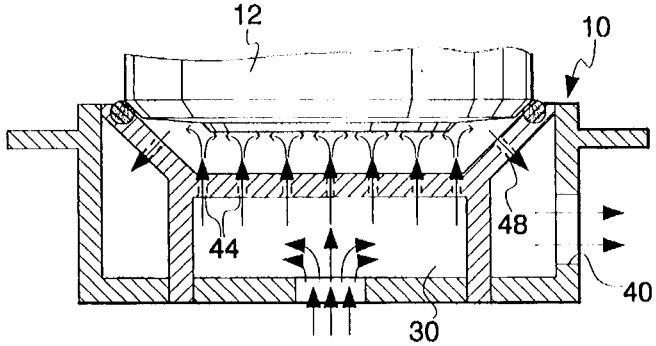
Figure 7D:
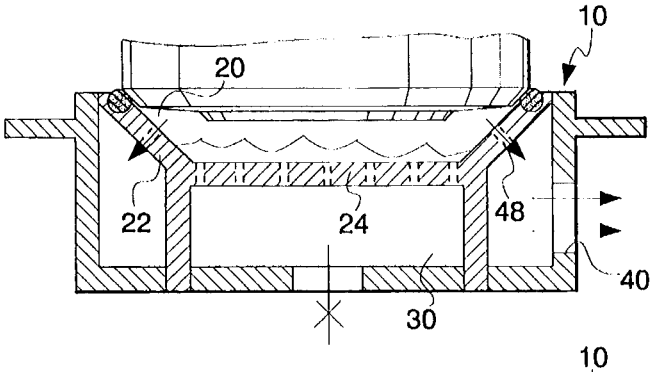

As a next step in the cleaning operation illustrated in FIG. 7*b*, cleaning media enters chamber 30. The cleaning media may either be pressurized or may be drawn by suction by an external vacuum source, such as the vacuum pump 64 illustrated in FIG. 2. In either event, FIG. 7*b* shows the initial entry of cleaning media into chamber 30. During this time, a vacuum continues to be applied to exit hole 40. FIG. 7*c* shows a later stage of operation, with cleaning media being passed through holes 44, so as to contact the valve 12. As described above, cleaning media passes through holes 48 so as to exit cleaning nozzle 10 through hole 40.

Figure 7E:
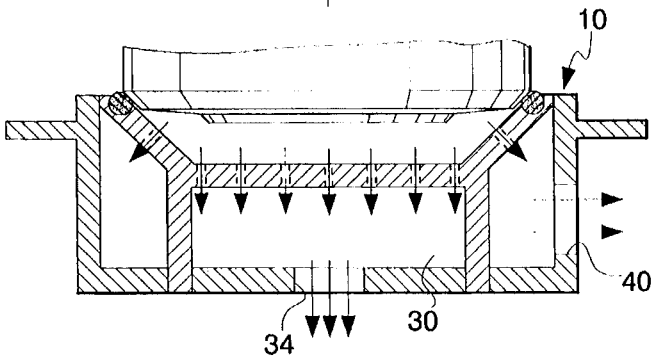

After the dispense valve is sufficiently cleaned, the flow of cleaning media entering chamber 30 is shut off while a vacuum continues to be applied through exit hole 40. At the moment of time illustrated in FIG. 7*d*, a vacuum continues to be applied to exit hole 40 so as to withdraw cleaning media filling recess 20. As mentioned above, it is preferred that the holes 48 be spaced above the recess wall 24 and accordingly a layer of cleaning media remains atop recess wall 24. Increasing the vacuum applied to the cleaning nozzle will draw down a certain amount of cleaning media, but may not be sufficient to completely withdraw all cleaning media from the cleaning nozzle. This may become important, for example, when the same cleaning nozzle is used with incompatible cleaning media, or when contamination of later applied cleaning media is to be avoided. Accordingly, as illustrated in FIG. 7*e*, a negative pressure or a vacuum is applied to entrance aperture 34. For example, one of the pumps 62, illustrated in FIG. 2, can be reversed to draw a vacuum through the cleaning nozzle 10. As shown in FIG. 7*e*, vacuum continues to be drawn through exit aperture 40, although this negative pressure may be lessened or removed to ensure that vacuum drawn at entrance aperture 34 successfully withdraws cleaning media which puddles atop the recess wall 24, and which may cling to the walls of chamber 30.

Referring to FIG. 9, liquid cleaning media enters conduit 110, while air or other material combines with the flow, under controlled operation of regulator 112. The combined flow then enters cleaning nozzle 10. In the preferred embodiment, air is injected into liquid cleaning media to provide the desired momentum impinging on the dispense valve surface. Although air injection reduces the mass of the mixture impinging on the dispense valve, the velocity imparted to the mixture can be readily increased, and the flow characteristics of the mixture through the holes 44 can be rendered more favorable. In addition, favorable cleaning can be obtained with a substantial savings on cleaning material.

In FIG. 10 a cleaning system generally indicated at 120 includes a conventional multi-section valve 122 which controls the flow of cleaning solution entering and leaving cleaning nozzle 10. Operation of valve 122 is schematically illustrated in FIG. 11. As indicated in FIGS. 7 and 11, cleaning solution may be drawn from a plurality of different sources 124*a*–124*c*. Valve 122 can direct flow into cleaning nozzle 10 through any one of the sources 124*a*–124*c*. Also, flow exiting cleaning nozzle 10 can be directed to any one of the sources 124*a*–124*c*, as desired. As indicated in solid lines in FIG. 11, one example of operation of valve 122 is shown, with material being drawn from and returning to the same source 124*c*.

However, with cleaning valve 122, cleaning solution drawn from sources 124*c* can, after passing through cleaning nozzle 10, be directed to a different source, such as source 124*b*. Further, valve 122 can be made to operate in sequence, first drawing solution from source 124*a*, returning the solution to that source. After the cleaning nozzle has been purged of cleaning solution from source 124*a*, valve 122 can direct cleaning solution from source 124*b*, returning the solution to source 124*b*. After the cleaning nozzle is purged of solution from source 124*b*, solution from source 124*c* can thereafter be routed through cleaning nozzle 10 by valve 122.

Further cleaning operations are possible with the present invention. For example, a cleaning system generally indicated at 130 is illustrated in FIG. 12. In this embodiment, cleaning solution is drawn from source 124*a*, being routed through valve 122 to enter cleaning nozzle 10. The cleaning solution exiting cleaning nozzle 10 is directed to a second cleaning source 124*b*, and does not return to source 124*a*. As indicated schematically in FIG. 12, cleaning solutions may be passed through cleaning nozzle 10 in batches. One important commercial application pertains to the cleaning of dispensing nozzles which deliver offset printing inks, especially such inks which have particularly strong coloring agents. For example, the arrangement of FIG. 12 can be used to clean a first valve with fresh cleaning solution. The first batch of cleaning solution exiting dispense nozzle 10 will be particularly dirty, and oftentimes will have elevated levels of grit suspended in the solution. This first batch of cleaning solution may be retained for other uses, or may be discarded. Thereafter, a second batch of cleaning solution can be circulated through dispense nozzle 10, being retained in a different receptacle. This somewhat cleaner solution can be reused in the initial cleaning stages for another dispense valve, for example.

Turning now to FIGS. 13–17, a cleaning system according to principles of the present invention, is generally indicated at 200. The cleaning system is shown mounted beneath a dispense system generally indicated at 202. The dispense system 202 includes a plurality of dispense valves 204 mounted on a movable tray 206 so as to be selectably positioned under a stationary actuator 208 having a jaw 210 for engaging the upper ends of the dispense valves. As indicated by arrow 214, jaw 210 is movable up and down to operate the dispense valve 204. The dispense valves 204 have dispense nozzles 220 from which material emerges for passage to a receptacle located below, not shown in the figures.

Referring to the bottom plan view of FIG. 15, tray 206 is mounted for movement in a plane, located underneath actuator 208. The arrangement for moving tray 206 is conventional, being sometimes termed an "X-Y table". In this arrangement, tray 206 is mounted on rails 224 and is driven by actuator 226 for movement in a direction of arrows 228. Actuator 226 is preferably pneumatic, but may also be hydraulic or electrically operated. Tray 206 is also movable in a perpendicular direction, being mounted on rails 232 for movement by actuator 234 in a direction of arrows 236. In a preferred embodiment shown in the figures, sixteen dispense valves are mounted on tray 206, and any one of the 16 valves can be indexed so as to be positioned underneath the stationery actuator 208.

A cleaning nozzle 10 is carried on a separate "X-Y table" for movement in a plane parallel to the plane of movement of tray 206. Cleaning nozzle 10 is mounted on a table 250 (see FIG. 15) which in turn is mounted on rails 252 for movement in a direction of arrows 254. Rails 252 are in turn mounted on rails 258 for movement in direction of arrows 260. Power for driving table 250 on rails 252, 258 may be provided by any suitable conventional means, such as a belt system traveling along the rails, driven by actuators 264, 266, respectively.

The aforementioned actuators are coupled by electrical conductors to a conventional programmable logic controller or similar control device. The device can independently control movement of tray 206 and table 250, but preferably coordinates their movements in the following manner. A desired dispense valve mounted on tray 206 is moved into position under actuator 208 and a desired dispensing operation is completed. Thereafter, the control device determines which dispense valve is to be positioned next, underneath actuator 208 and plans a path for movement of tray 206. The control device then operates actuators 264, 266 so as to move table 250 along the same path, so that cleaning nozzle 10 can follow directly underneath the last dispensed valve as it moves away from actuator 208. During this time, a cleaning nozzle is moved into contact with a dispense valve in a manner indicated in FIGS. 16 and 17. Referring now to FIGS. 16 and 17, a plurality of solenoid actuators 274 are mounted on table 250 so as to move the cleaning nozzle 10 up and down in the direction of arrows 276.

As a dispense valve is either located at the dispense position or recently moved away from actuator 208, cleaning nozzle 10 is brought underneath the dispense valve and, under control of the control device, the cleaning nozzle is raised into position, being seated against the dispense valve. Cost savings may be obtained if the control system is required only to "home" the cleaning nozzle at a point underneath the dispense nozzle. The cleaning cycle is then initiated and preferably completed while tray 206 is being indexed to bring the next dispense valve underneath actuator 208, and if necessary, while a second dispensing operation is being carried out. Thereafter, solenoids 274 are controlled by the control device and actuators 264, 266 are operated by device to position the cleaning nozzle 10 under the dispense valve which has most recently completed a dispensing operation. In this manner, dispensing operations need not be halted for valve cleaning. The actuators 264, 266 could also be of the pneumatic or hydraulic type if desired.

The cleaning nozzle 10 has been described above with respect to a single cleaning valve. However, the present invention is also directed to use of cleaning valves which service a dispense head, having multiple discharge nozzles. Referring to FIGS. 18 and 19, a dispense head 300 has a plurality of incoming conduits 302 terminating in a plurality of dispense nozzle 304. The dispense head 300 has a sidewall 310 which preferably includes a lower beveled corner. The cleaning nozzle 10 is the same as that described above with reference to FIGS. 1 and 2 and the cleaning operations carried out with nozzle 10 are the same as those described above. It will be readily appreciated that cleaning nozzle 10 can be reconfigured in size and shape to accommodate a wide variety of dispense valves.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A cleaning nozzle, comprising:

a housing having opposed first and second ends, a sidewall extending between the first and second ends and an inlet wall at the second end;

a tapered wall extending from the first end;

a recess wall joined to the sidewall at a point remote from the first end of the housing;

the recess wall and the sidewall cooperating to form an open ended concave recess portion extending into the housing from the first end of the housing;

a standoff wall between the recess wall and the inlet wall, cooperating therewith to form an inlet chamber within the housing;

the sidewall defining an outlet port;

the inlet wall defining an inlet port communicating with the inlet chamber;

the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media;

the tapered wall defining at least one withdrawal aperture so that cleaning media can be withdrawn away from the recess portion to the outlet port; and connection means coupling the outlet port to the withdrawal aperture.

2. The cleaning nozzle of claim 1 further comprising a resilient gasket adjacent the first end of the housing.

3. The cleaning nozzle of claim 1 wherein the tapered wall cooperates with the sidewall to form an outlet chamber comprising the connection means.

4. The cleaning nozzle of claim 3 wherein the standoff wall and the inlet wall cooperate with the sidewall and tapered wall to form the outlet chamber.

5. The cleaning nozzle of claim 1 wherein the tapered wall is generally frustoconical and the recess wall has a generally circular wall surface facing the recess portion.

6. The cleaning nozzle of claim 5 wherein the apertures defined by the recess wall are arranged in a circle and the apertures defined by the tapered wall are arranged in an outer concentric circle.

7. The cleaning nozzle of claim 1 wherein the recess wall is rotatably mounted in the housing by mounting means.

8. The combination of a dispense nozzle and cleaning nozzle therefor, comprising:

a dispense nozzle having a dispense end from which material is dispensed;

a housing having opposed first and second ends, a sidewall extending between the first and second ends and an inlet wall at the second end;

a tapered wall extending from the first end;

a recess wall joined to the sidewall at a point remote from the first end of the housing;

the recess wall and the sidewall cooperating to form an open ended concave recess portion extending into the housing from the first end of the housing, receiving the dispense end of the nozzle to form a cleaning chamber therewith;

a standoff wall between the recess wall and the inlet wall, cooperating therewith to form an inlet chamber within the housing;

the sidewall defining an outlet port;

the inlet wall defining an inlet port communicating with the inlet chamber;

the recess wall defining a plurality of apertures extending from the inlet cavity to the cleaning chamber and pointing toward the dispense end of the nozzle;

the tapered wall defining at least one withdrawal aperture so that cleaning media can be withdrawn away from the recess portion to the outlet port; and connection means coupling the outlet port to the withdrawal aperture.

9. The cleaning nozzle of claim 8 further comprising a resilient gasket adjacent the first end of the housing so as to seat against the dispense nozzle.

10. The cleaning nozzle of claim 8 wherein the tapered wall cooperates with the sidewall to form an outlet chamber comprising the connection means.

11. The cleaning nozzle of claim 8 wherein the standoff wall and the inlet wall cooperate with the sidewall and tapered wall to form the outlet chamber.

12. The cleaning nozzle of claim 8 wherein the tapered wall is generally frustoconical and the recess wall has a generally circular wall surface facing the recess portion.

13. The cleaning nozzle of claim 12 wherein the apertures defined by the recess wall are arranged in a circle.

14. The cleaning nozzle of claim 13 wherein the apertures defined by the tapered wall are arranged in an outer concentric circle.

15. Cleaning apparatus for cleaning a dispense nozzle, comprising:

a nozzle including a housing having opposed first and second ends, a sidewall extending between the first and second ends and an inlet wall at the second end, a tapered wall extending from the first end, a recess wall joined to the sidewall at a point remote from the first end of the housing, the recess wall and the sidewall cooperating to form an open ended concave recess portion extending into the housing from the first end of the housing, a standoff wall between the recess wall and the inlet wall, cooperating therewith to form an inlet chamber within the housing, the sidewall defining an outlet port, the inlet wall defining an inlet port communicating with the inlet chamber, the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media, the tapered wall defining at least one withdrawal aperture so that cleaning media can be withdrawn away from the recess portion to the outlet port, connection means coupling the outlet port to the withdrawal aperture; and transport means for transporting the cleaning nozzle about a dispense area, comprising a table supporting the cleaning nozzle, seating means for seating the cleaning nozzle against a part to be cleaned by moving the cleaning nozzle toward and away from the table, and the transport means further comprising x-y indexing means for moving the cleaning nozzle and table about a plane.

16. The cleaning nozzle of claim 15 further comprising a resilient gasket adjacent the first end of the housing.

17. The cleaning nozzle of claim 15 wherein the tapered wall cooperates with the sidewall to form an outlet chamber comprising the connection means.

18. The cleaning nozzle of claim 15 wherein the standoff wall and the inlet wall cooperate with the sidewall and tapered wall to form the outlet chamber.

19. The cleaning nozzle of claim 15 wherein the tapered wall is generally frustoconical and the recess wall has a generally circular wall surface facing the recess portion.

20. The cleaning nozzle of claim 19 wherein the apertures defined by the recess wall are arranged in a circle.

21. The cleaning nozzle of claim 20 wherein the apertures defined by the tapered wall are arranged in an outer concentric circle.

22. A combination of a valve assembly having a plurality of valves and cleaning apparatus for cleaning the valves, including:

transport means for transporting the valve assembly about a dispense area, comprising a valve table supporting the valves and x-y indexing means for moving the valves and valve table about a plane;

a cleaning nozzle comprising a nozzle housing having opposed first and second ends, a sidewall extending between the first and second ends and an inlet wall at the second end, a tapered wall extending from the first end, a recess wall joined to the sidewall at a point remote from the first end of the housing, the recess wall and the sidewall cooperating to form an open ended concave recess portion extending into the housing from the first end of the housing, a standoff wall between the recess wall and the inlet wall, cooperating therewith to form an inlet chamber within the housing, the sidewall defining an outlet port, the inlet wall defining an inlet port communicating with the inlet chamber, the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media, the tapered wall defining at least one withdrawal aperture so that cleaning media can be withdrawn away from the recess portion to the outlet port, connection means coupling the outlet port to the withdrawal aperture; and transport means for transporting the cleaning nozzle about a dispense area, comprising a cleaning table supporting the cleaning nozzle, seating means for seating the cleaning nozzle against a valve to be cleaned by moving the cleaning nozzle toward and away from the cleaning table, and the transport means further comprising x-y indexing means for moving the cleaning nozzle and cleaning table about a plane parallel to the plane of movement of the valves.

23. The cleaning nozzle of claim 22 further comprising a resilient gasket adjacent the first end of the housing.

24. The cleaning nozzle of claim 22 wherein the tapered wall cooperates with the sidewall to form an outlet chamber comprising the connection means.

25. The cleaning nozzle of claim 22 wherein the standoff wall and the inlet wall cooperate with the sidewall and tapered wall to form the outlet chamber.

26. The cleaning nozzle of claim 22 wherein the tapered wall is generally frustoconical and the recess wall has a generally circular wall surface facing the recess portion.

27. The cleaning nozzle of claim 26 wherein the apertures defined by the recess wall are arranged in a circle.

28. The cleaning nozzle of claim 27 wherein the apertures defined by the tapered wall are arranged in an outer concentric circle.

29. The combination of a dispense head and cleaning nozzle therefor, comprising:

a dispense head having a plurality of dispense nozzles terminating at a dispense end;

a cleaning nozzle comprising a nozzle housing having opposed first and second ends, a sidewall extending between the first and second ends and an inlet wall at the second end, a tapered wall extending from the first end, a recess wall joined to the sidewall at a point remote from the first end of the housing, the recess wall and the sidewall cooperating to form an open ended concave recess portion extending into the housing from the first end of the housing, a standoff wall between the recess wall and the inlet wall, cooperating therewith to form an inlet chamber within the housing, the sidewall defining an outlet port, the inlet wall defining an inlet port communicating with the inlet chamber, the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media, the tapered wall defining at least one withdrawal aperture so that cleaning media can be withdrawn away from the recess portion to the outlet port, connection means coupling the outlet port to the withdrawal aperture.

30. The cleaning nozzle of claim 29 further comprising a resilient gasket adjacent the first end of the housing so as to seat against the dispense nozzle.

31. The cleaning nozzle of claim 29 wherein the tapered wall cooperates with the sidewall to form an outlet chamber comprising the connection means.

32. The cleaning nozzle of claim 29 wherein the standoff wall and the inlet wall cooperate with the sidewall and tapered wall to form the outlet chamber.

33. The cleaning nozzle of claim 29 wherein the tapered wall is generally frustoconical and the recess wall has a generally circular wall surface facing the recess portion.

34. The cleaning nozzle of claim 33 wherein the apertures defined by the recess wall are arranged in a circle.

35. The cleaning nozzle of claim 34 wherein the apertures defined by the tapered wall are arranged in an outer concentric circle.

36. Cleaning apparatus, comprising:

a cleaning nozzle including a housing having opposed first and second ends, a sidewall extending between the first and second ends and an inlet wall at the second end, a tapered wall extending from the first end, a recess wall joined to the sidewall at a point remote from the first end of the housing, the recess wall and the sidewall cooperating to form an open ended concave recess portion extending into the housing from the first end of the housing, a standoff wall between the recess wall and the inlet wall, cooperating therewith to form an inlet chamber within the housing, the tapered wall cooperating with the sidewall to form an outlet chamber, the sidewall defining an outlet port communicating with the outlet chamber, the inlet wall defining an inlet port communicating with the inlet chamber, the recess wall defining a plurality of apertures extending from the inlet cavity to the recess portion, so that cleaning media entering the inlet chamber has a directed path toward the first end of the housing, whereby an external part seated against the housing adjacent its first end will lie in the path of travel of the cleaning media, the tapered wall defining at least one aperture communicating from the recess portion to the outlet chamber so that cleaning media can be withdrawn away from the recess portion to the outlet port;

a plurality of vessels for containing cleaning materials; and a control valve having multiple inputs coupled to the vessels and an output coupled to the inlet port of the cleaning nozzle, the control valve operable to direct material from at least one of the vessels to the cleaning nozzle input.

37. The apparatus of claim 36 further comprising coupling means for coupling the output port of the cleaning nozzle to the control valve, and wherein the control valve is operable to direct material from the output port of the cleaning nozzle to at least one of the vessels.

* * * * *